US006766782B1

(12) United States Patent
Martin

(10) Patent No.: US 6,766,782 B1
(45) Date of Patent: Jul. 27, 2004

(54) AIRBOX PLUG

(76) Inventor: Monty Martin, 15360 Los Altos Dr., Hacienda Heights, CA (US) 91745

( * ) Notice: Subject to any disclaimer, the term of this patent is extended or adjusted under 35 U.S.C. 154(b) by 0 days.

(21) Appl. No.: 10/425,453

(22) Filed: Apr. 28, 2003

(51) Int. Cl.[7] ..... F02B 77/00
(52) U.S. Cl. ..... 123/198 E; 55/DIG. 28
(58) Field of Search ..... 123/198 E; 55/DIG. 28

(56) References Cited

U.S. PATENT DOCUMENTS 4,671,216 A 6/1987 Itoh ..... 123/52
5,918,576 A 7/1999 Ohoka et al. ..... 123/198
6,216,661 B1 * 4/2001 Pickens et al. ..... 123/198 E

* cited by examiner

*Primary Examiner*—Noah P. Kamen
(74) *Attorney, Agent, or Firm*—Goldstein Law Offices, P.C.

(57) ABSTRACT

An airbox plug, for temporarily covering an airbox having an airbox opening and an airbox rim at the airbox opening. The airbox rim having a mounting bracket strip extending across the airbox rim. The mounting bracket strip has a mounting hole and a mounting core centered on the bracket strip. The airbox plug has a gasket cover having a top, bottom, and periphery, and a gasket mounted to the gasket cover bottom and corresponding with the periphery. A central bolt extends through the gasket cover and is partially surrounded on the bottom by a pair of complementary arcs. The airbox plug is installed to cover the airbox opening by engaging the central bolt into the mounting hole, engaging the mounting core with the complementary arcs to prevent the gasket cover from spinning as the gasket is tightened onto the airbox rim.

6 Claims, 3 Drawing Sheets

AIRBOX PLUG

BACKGROUND OF THE INVENTION

The invention relates to an airbox plug. More particularly, the invention relates to a device for plugging a vehicle airbox to prevent introduction of moisture and debris into the airbox while servicing or cleaning the vehicle.

Internal combustion engines require a fuel and air mixture in order for combustion to occur. It is well known that the air in our atmosphere is far from pure. With regard to engines, the impurities found in the air can hamper the performance of the engine. Even further, if debris is allowed to enter the engine, it can cause irreparable damage.

To clean the air entering the engine as much as possible, the engine usually involves a filtration scheme which may involve one or more mechanical filters. Often the air filter is provided as a changeable or cleanable cartridge, which mates with the engine in an 'airbox', which provides an air opening through which air can enter the engine. With regard to motorcycle engines, U.S. Pat. No. 4,671,216 to Itoh and U.S. Pat. No. 5,918,576 to Ohoka show various air intake and air cleaner systems.

When the vehicle is being serviced, when the filter cartridge is being cleaned, or when the vehicle is being cleaned without the cartridge seated in place, the engine is vulnerable to dust, debris, and moisture. Accordingly, it would be desirable to protect the airbox when the filter cartridge is not in place.

A common practice of 'stuffing a rag' into the opening does not adequately protect the engine—since the rag does not fully seal the airbox and debris is often present on the rag itself. While these units may be suitable for the particular purpose employed, or for general use, they would not be as suitable for the purposes of the present invention as disclosed hereafter.

SUMMARY OF THE INVENTION

It is an object of the invention to provide an airbox plug which prevents infiltration of dust, dirt, moisture and debris into an engine when the filter cartridge typically mated with the airbox is missing. Accordingly, the airbox plug mates with the airbox to effectively seal its air opening.

It is another object of the invention to provide an airbox plug which effectively seals the opening of the airbox. Accordingly, the airbox plug is sized and shaped to accommodate the opening of the airbox, and has a gasket which effects a substantially air-tight and water-tight seal with the opening.

It is a further object of the invention to provide an airbox plug which is easily attached to the airbox, reliably attaches to the airbox, and then is easily removed when desired. Accordingly, the airbox plug has a central bolt which mates with the existing filter mounting hole. The airbox plug may be fastened by the simple manipulation of a wing nut attached on the bolt to secure the bolt within the filter mounting hole. Removal of the airbox plug involves reversing the mounting procedure.

It is a still further object of the invention to provide an airbox plug which is durable for continued use. Accordingly, the upper surface has a central protrusion through which the central bolt is mounted. The central protrusion makes it easier to manipulate the wings and fasten it down toward the upper surface. A washer is mounted upon the central protrusion, concentric with the bolt, to prevent damage to the central protrusion when the bolt is tightened.

The invention is an airbox plug, for temporarily covering an airbox having an airbox opening and an airbox rim at the airbox opening. The airbox rim having a mounting bracket strip extending across the airbox rim. The mounting bracket strip has a mounting hole and a mounting core centered on the bracket strip. The airbox plug has a gasket cover having a top, bottom, and periphery, and a gasket mounted to the gasket cover bottom and corresponding with the periphery. A central bolt extends through the gasket cover and is partially surrounded on the bottom by a pair of complementary arcs. The airbox plug is installed to cover the airbox opening by engaging the central bolt into the mounting hole, engaging the mounting core with the complementary arcs to prevent the gasket cover from spinning as the gasket is tightened onto the airbox rim.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
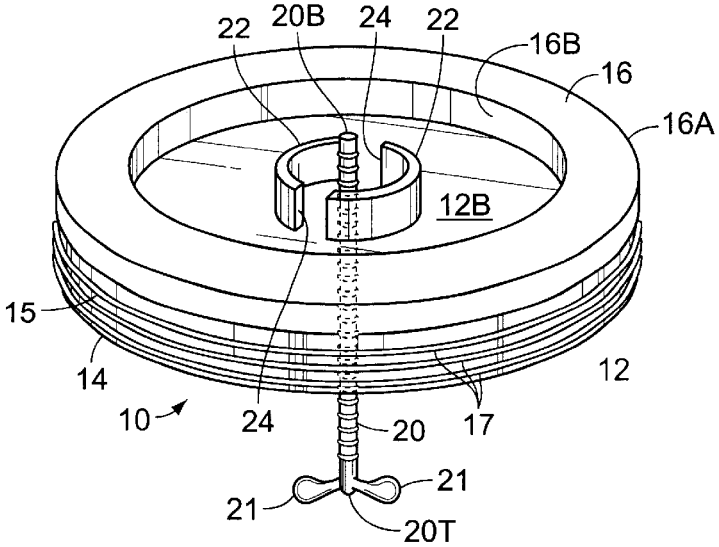
FIG. 1 is a diagrammatic perspective view, of a bottom orientation of the invention in a circular configuration.

FIG. 1 illustrates an airbox plug 10, having a gasket cover 12, having a gasket cover bottom 12B, and a gasket 16 mounted to the gasket cover bottom 12B. The gasket cover 12 has an outer periphery 14 and sides 15. The gasket 16 has an outer edge 16A, an inner edge 16B, and a thickness. The outer edge 16A substantially follows the outer periphery 14 of the gasket cover 12. The inner edge 16B extends inward of the outer edge 16A, is concentric with the outer edge 16B, and thus defines an open ring. The gasket cover 12 is substantially solid, preferably made of plastic or rubber, and the gasket 16 is preferably made of a compressible material, such as foam. The gasket cover 12 preferably has a plurality of concentric indents 17 extending around the sides 15, making it easier to pull the airbox plug 10 off of an airbox, especially if it becomes covered with grease.

Figure 2:
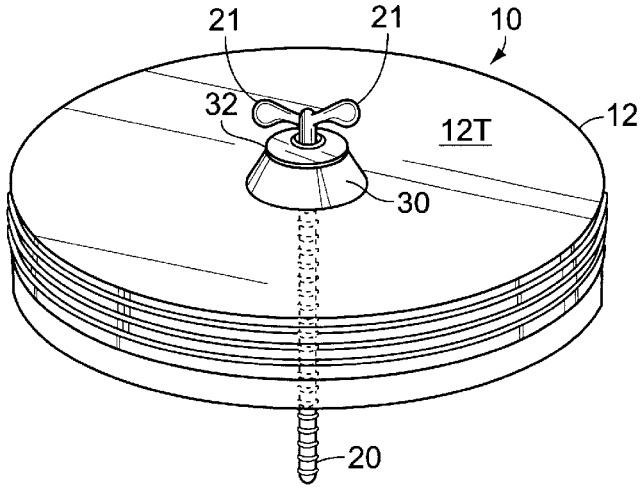
FIG. 2 is a diagrammatic perspective view of the invention, in a top orientation.

A central bolt 20 extends through the gasket cover 12, and has a central bolt bottom 20B which protrudes out the gasket cover bottom 12B. The gasket cover 12 is partially surrounded by a pair of complementary arcs 22, which extend downward from the cover bottom 12B, and define a pair of substantially equal width lateral openings 24 such that the central bolt 20 protrudes from the gasket cover bottom 12B directly between said lateral openings 24. Referring to FIG. 1 and 2, the central bolt has a central bolt top 20T—fully opposite from the central bolt bottom 20B. The central bolt top 20T has a pair of opposed wings 21 which facilitate rotation and tightening of the central bolt by the user. In addition, it should be noted that the central bolt 20 may be any suitable length, and is illustrated herein with exaggerated length for illustrative purposes.

FIG. 2 illustrates the airbox plug 10, and in particular illustrates that the gasket cover 12 has a gasket cover top 12T. The gasket cover top 12T is substantially flat except has a central protrusion 30 forming a mound extending upwardly therefrom and substantially centered thereon. The central bolt 20 extends concentrically through the central protrusion 30. A washer 32 is preferably located atop the central protrusion 30, such that the central bolt 20 extends through the central protrusion 30 and through the washer 32 thereon. Accordingly, the central protrusion 30 allows the wings 21 on the central bolt 20 to be manipulated by the user, and tightened downward upon the washer, such that the central protrusion 30 provides sufficient clearance to allow the users fingers to manipulate the wings 21 until the bolt 20 is tightened and the washer 32 prevents the gasket cover 12 from being damaged when the bolt 20 is tightened downwardly thereupon.

Figure 3:
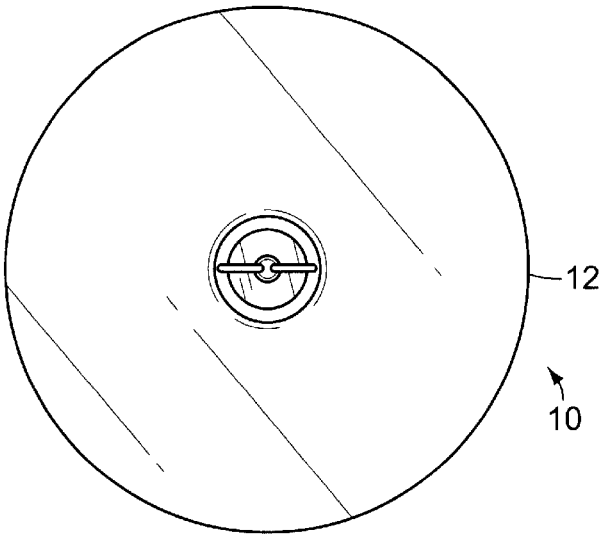
FIG. 3 is a top plan view of the circular configuration of the invention.
Figure 4:
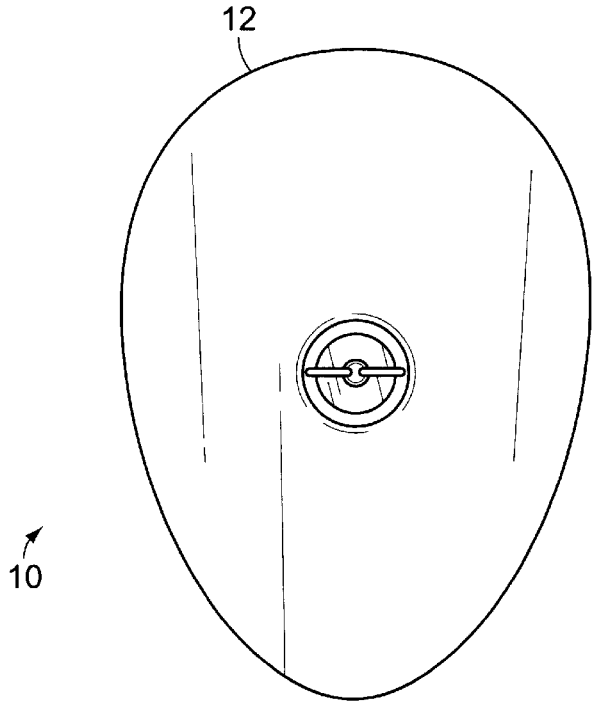
FIG. 4 is a top plan view of an alternate, egg-shaped configuration of the invention.

FIG. 3 is a top plan view of a circular embodiment of the airbox plug 10. Accordingly, this embodiment is intended for use with circular airboxes. However, airboxes 10 on different vehicles have different configurations—including the 'egg-shaped' configuration shown in FIG. 4. The present invention can be readily adapted so that the gasket cover 12 (and gasket therebeneath) is sized and shaped according to the airbox with which it is intended to be used.

Figure 5:
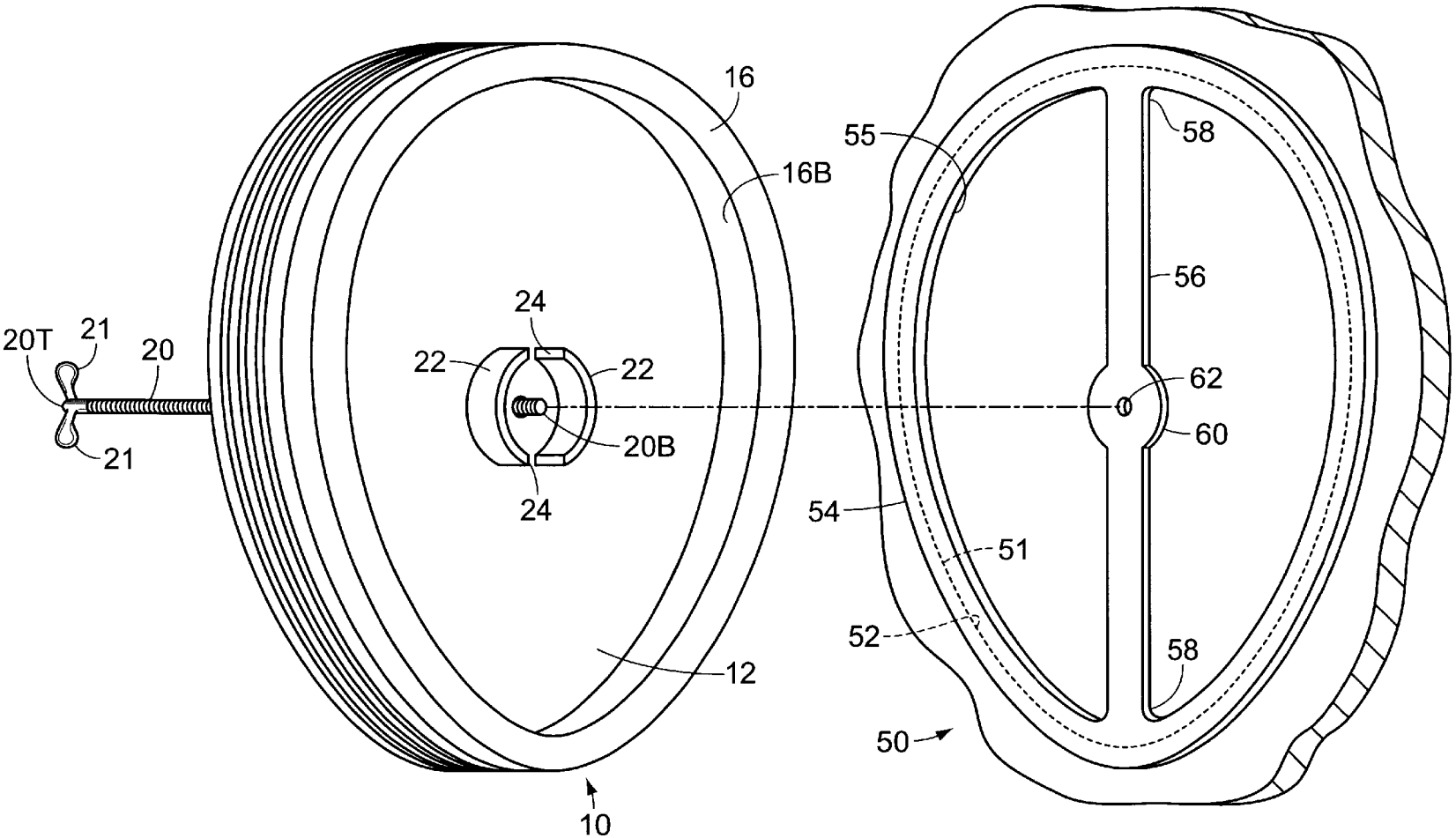
FIG. 5 is a diagrammatic perspective view of a portion of an airbox, with parts broken away, which provides context for the mounting of the present invention.

FIG. 5 is an exploded view, illustrating use of the airbox plug 10 with an air box 50, having an airbox opening perimeter 51 defining an airbox opening 52. The airbox opening is partially covered by a rim 54 which is generally adhered to the airbox 50 and extends both radially inwardly and outwardly from the airbox opening perimeter 51 as illustrated in FIG. 5. The rim 54 has a rim periphery 55 which itself defines an opening inwardly therefrom. A filter cartridge is normally mounted to substantially span the opening 52 and thus the rim periphery 55, and cover the rim 54. A mounting bracket strip 56 is substantially flat and extends across the opening, substantially through its center, has a pair of mounting bracket strip ends 58 at the rim 54, and a mounting core 60 centered between the mounting bracket strip ends 58 over the airbox opening 52. The mounting core 60 is a circular lateral widening of the mounting bracket strip 56. A mounting hole 62 is located centrally on the mounting core 60. The mounting hole 62 is internally threaded, or otherwise configured so that the central bolt 20 can fasten therein.

Once the filter cartridge is removed, the airbox plug 10 should be immediately installed to cover the airbox opening 52. In particular, the bottom 20B of the central bolt 20 is aligned with the mounting hole 62 and the user may begin tightening the central bolt 20 by manipulating the wings 21 at the top 20T thereof. As the central bolt 20 is tightened, the gasket 16 is positioned with over the airbox rim 54, and the complementary arcs 22 are aligned to extend around the mounting core 60 such that the mounting bracket strip 56 immediately adjacent thereto extends through the lateral openings 24. Then, as the central bolt 20 is continually tightened, the mounting core 60 and mounting bracket strip 56 immediately interacts with the complementary arcs 22 adjacent thereto in order to prevent the airbox plug 10 from spinning—especially during final tightening of the central bolt 20. When the gasket cover 12 is fully tightened downward against the mounting core 60, thereby tightening the gasket 16 against the mounting rim 54, the gasket 16 extends fully over the airbox rim, creating a tight seal therebetween which prevents the infiltration of dust, dirt, debris, and moisture into the airbox opening 52. Removal of the airbox plug 10 involves simply unscrewing the central bolt 20, and lifting the airbox plug 10 upward and off of the airbox.

In conclusion, herein is presented an airbox plug which allows a vehicle airbox to be effectively protected from the infiltration of dirt, debris, and moisture from entering the engine when the filter cartridge has been temporarily removed from the airbox. The invention is illustrated by example in the foregoing description and in the attached drawing figures. It should be understood, however, that numerous variations to the invention are possible, while adhering to the inventive concept. Such variations are contemplated as being a part of the present invention.

What is claimed is:

1. An airbox plug, for temporarily protecting an airbox having an airbox opening having an airbox opening perimeter, and an airbox rim mounted at the airbox opening perimeter having a mounting strip extending laterally across the airbox rim and having a mounting core centered thereon, and a mounting hole extending vertically through the mounting core mounting strip substantially centrally within the airbox opening, comprising:

a gasket cover, having a top, a bottom, an outer periphery;

a gasket, having an outer edge and an inner edge, the gasket attached to the gasket cover bottom with the outer edge corresponding with the periphery of the gasket cover;

a central bolt having a top and a bottom, the top protruding above the gasket cover top, the bottom extending through the gasket cover bottom for mating with the mounting hole in the mounting strip, the central bolt top having means for hand tightening the central bolt; and a pair of complementary arcs, extending downward from the gasket cover bottom, partially surrounding the central bolt at the gasket bottom, and defining a pair of lateral openings therebetween, the complementary arcs selectively extending around the mounting core with the mounting strip extending through the lateral openings to allow the gasket cover to be tightened downward toward the airbox rim, such that the gasket is tightened downward against the airbox rim, wherein the complementary arcs prevent the gasket cover from spinning during tightening of the gasket cover.

2. The airbox plug as recited in claim 1, wherein the gasket top is substantially flat, except has a central protrusion extending upwardly therefrom, the central bolt extends through the central protrusion so that the bolt top can be tightened downwardly thereupon.

3. The airbox plug as recited in claim 2, wherein a washer is located upon the central protrusion, concentric with the washer, so that the central bolt top can be fastened thereupon without damaging the gasket cover.

4. The airbox plug as recited in claim 3, wherein the means for hand tightening the central bolt further comprise a pair of complementary wings at the central bolt top.

5. An airbox covering method, for temporarily sealing an airbox opening having an airbox opening perimeter and an airbox rim at the airbox opening, the airbox rim having a mounting strip extending across the airbox rim with a mounting hole substantially centered within the airbox opening, using an airbox plug having a gasket cover having a top, bottom and periphery, a gasket attached to the gasket bottom, and a central bolt extending from the gasket cover top through the gasket cover bottom, comprising the steps of:

removing a filter cartridge from the airbox;

aligning the central bolt within the mounting hole;

threading the central bolt into the mounting hole;

aligning the gasket with the airbox rim;

holding the gasket tightly upon the airbox rim by tightening the gasket cover against the mounting bracket by tightening the central bolt.

6. The airbox covering method as recited in claim 5, wherein the mounting strip has a mounting core substantially centered thereon with the mounting hole extending vertically through the mounting core; wherein the airbox plug has a pair of complementary arcs extending downward from the gasket cover bottom and partially surrounding the central bolt thereby defining a pair of lateral openings; wherein the step of aligning the gasket with the airbox rim further comprises aligning the complementary arcs with the central core; and wherein the step of tightening the gasket cover against the mounting bracket further comprises preventing the airbox plug from spinning by holding the mounting core with the complementary arcs.

* * * * *